US008139809B2

(12) United States Patent
Jubelirer et al.

(10) Patent No.: US 8,139,809 B2
(45) Date of Patent: Mar. 20, 2012

(54) CABLE MANAGEMENT FOR PERSONAL MEDIA PLAYER ACCESSORIES

(75) Inventors: Matthew Jubelirer, San Diego, CA (US); Carl Joseph Ledbetter, Mercer Island, WA (US); John K. Ikeda, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 1036 days.

(21) Appl. No.: 12/050,943

(22) Filed: Mar. 19, 2008

(65) Prior Publication Data

US 2009/0238395 A1 Sep. 24, 2009

(51) Int. Cl.
*H04R 1/02* (2006.01)
*H04R 1/00* (2006.01)

(52) U.S. Cl. ..... 381/385; 381/370; 381/388

(58) Field of Classification Search ..... 381/370, 381/374, 388, 385
See application file for complete search history.

(56) References Cited

U.S. PATENT DOCUMENTS

| | | | | |
|---|---|---|---|---|
| 5,845,197 | A * | 12/1998 | Hada et al. | 455/569.1 |
| 6,370,401 | B1 | 4/2002 | Baranowski et al. | |
| 6,826,782 | B2 | 12/2004 | Jordan | |
| 6,847,724 | B1 | 1/2005 | Weng et al. | |
| 7,072,476 | B2 | 7/2006 | White et al. | |
| 7,077,693 | B1 | 7/2006 | Symons | |
| 2002/0094094 | A1 * | 7/2002 | Shin | 381/104 |
| 2004/0165720 | A1 | 8/2004 | Paulson et al. | |
| 2005/0025329 | A1 * | 2/2005 | Lee | 381/370 |
| 2005/0058316 | A1 * | 3/2005 | Yanagishita et al. | 381/371 |
| 2006/0243845 | A1 | 11/2006 | Wegner | |
| 2006/0285715 | A1 * | 12/2006 | Drambarean et al. | 381/380 |
| 2007/0028346 | A1 | 2/2007 | Williams | |
| 2007/0036376 | A1 * | 2/2007 | Fried | 381/312 |
| 2007/0052523 | A1 * | 3/2007 | Jin et al. | 340/10.2 |
| 2007/0147630 | A1 | 6/2007 | Chiloyan | |
| 2009/0169044 | A1 * | 7/2009 | Kashiwagi et al. | 381/384 |

OTHER PUBLICATIONS

"Audio-Technica Introduces New Import Series Headphones", http://www.audio-technica.com/cms/news/a923a45caefebccc/index.html, Jan. 5, 2006.

"Jensen Clip-on Headphones with Volume Control (JHC105)", http://www.amazon.com/jensen-Clip-Headphone-Control-JHC105/dp/B0009VFF1Y.

* cited by examiner

*Primary Examiner* — Anh Mai
(74) *Attorney, Agent, or Firm* — Mayer & Williams

(57) ABSTRACT

An arrangement for managing cables of accessories such as earphone sets, chargers, and synchronization arrangements used with portable electronic devices is provided by a flexible and elastically deformable loop that extends from a base that optionally includes a hook or other loop retention feature. The base may be alternatively configured to be integrally formed with a component of an accessory, or be configured as a discrete clip that may be detachably coupled to the component, or to the cable portion of the accessory. The elastically deformable loop is configured to be removably fastenable by a user to articles such as buttons on clothing to help keep cables out of the way when the accessory is in use. In addition, the elastically deformable loop may be used to keep an accessory cable neatly stowed during storage by being stretched around a bundled cable and then secured on the hook.

20 Claims, 10 Drawing Sheets

CABLE MANAGEMENT FOR PERSONAL MEDIA PLAYER ACCESSORIES

BACKGROUND

Portable computing devices including personal media players such as MP3 (Moving Pictures Expert Group, MPEG-1, audio layer 3) players, laptop PCs (personal computers), PDAs (personal digital assistants), mobile phones, smart phones, and similar devices commonly interact with accessories that utilize wires or cables. One example is earphones that plug into a portable media player that enables a user to privately listen to music or other audio content that is being rendered by the player. Other common accessories include cables used with power adapters to charge the batteries in the portable device, or to connect the portable device to another device like a desktop PC to synchronize, for example, content, calendars, tasks, contacts, and other data between them.

While portable devices are very popular and have become widely accepted and used in all kinds of environments, some users have indicated a desire for better ways to manage the cables and wires when using accessories. To use the case of personal media players as an example, the players are commonly temporarily stored in a bag or a pocket while in use so that the cable extends from the player to the earphones on the user's head. The user is then free to move about and listen to audio while performing all kinds of activities.

But all too often it seems, users can inadvertently drag, catch, or snag the earphone cable on themselves or other objects as they move around. For example, the earphone cable can get caught on the arm of a chair when the user gets up, or the cable can get snagged by the user's hand or arm when opening a door. These situations may not only be surprising to users when the earphones get pulled off their head, but can also cause real damage to the earphones or to the personal media player. Users have also expressed frustration when trying to keep accessory cables neat, tidy, and untangled when the accessories are stored between uses.

This Background is provided to introduce a brief context for the Summary and Detailed Description that follow. This Background is not intended to be an aid in determining the scope of the claimed subject matter nor be viewed as limiting the claimed subject matter to implementations that solve any or all of the disadvantages or problems presented above.

SUMMARY

An arrangement for managing cables of accessories such as earphone sets, chargers, and synchronization and docking systems used with portable electronic devices is provided by a flexible and elastically deformable loop that extends from a base that optionally includes a hook or other loop retention feature. The base may be alternatively configured to be integrally formed with a component of an accessory, or be configured as a discrete clip that may be detachably coupled to the component, or to the cable portion of the accessory. The elastically deformable loop is configured to be removably fastenable by a user to articles such as buttons on clothing to help manage and keep cables out of the way when the accessory is in use. In addition, the elastically deformable loop may be used to keep an accessory cable neatly stowed during storage by being stretched around a bundled cable and then secured on the hook by the user.

In various illustrative examples, the components used in the earphones share a portion with a common shape to enable a cable management clip to be removably coupled to the earphones at different points. For example, a user may attach the same clip (at different times) to the slider, cable splitter, cable plug, or earphone speaker according to the user's preference. In some instances, the user may wish to use multiple cable management clips so that the earphones can be even more securely managed.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DESCRIPTION OF THE DRAWINGS

Like reference numerals indicate like elements in the drawings. Elements are not drawn to scale unless otherwise indicated.

DETAILED DESCRIPTION

Figure 1:
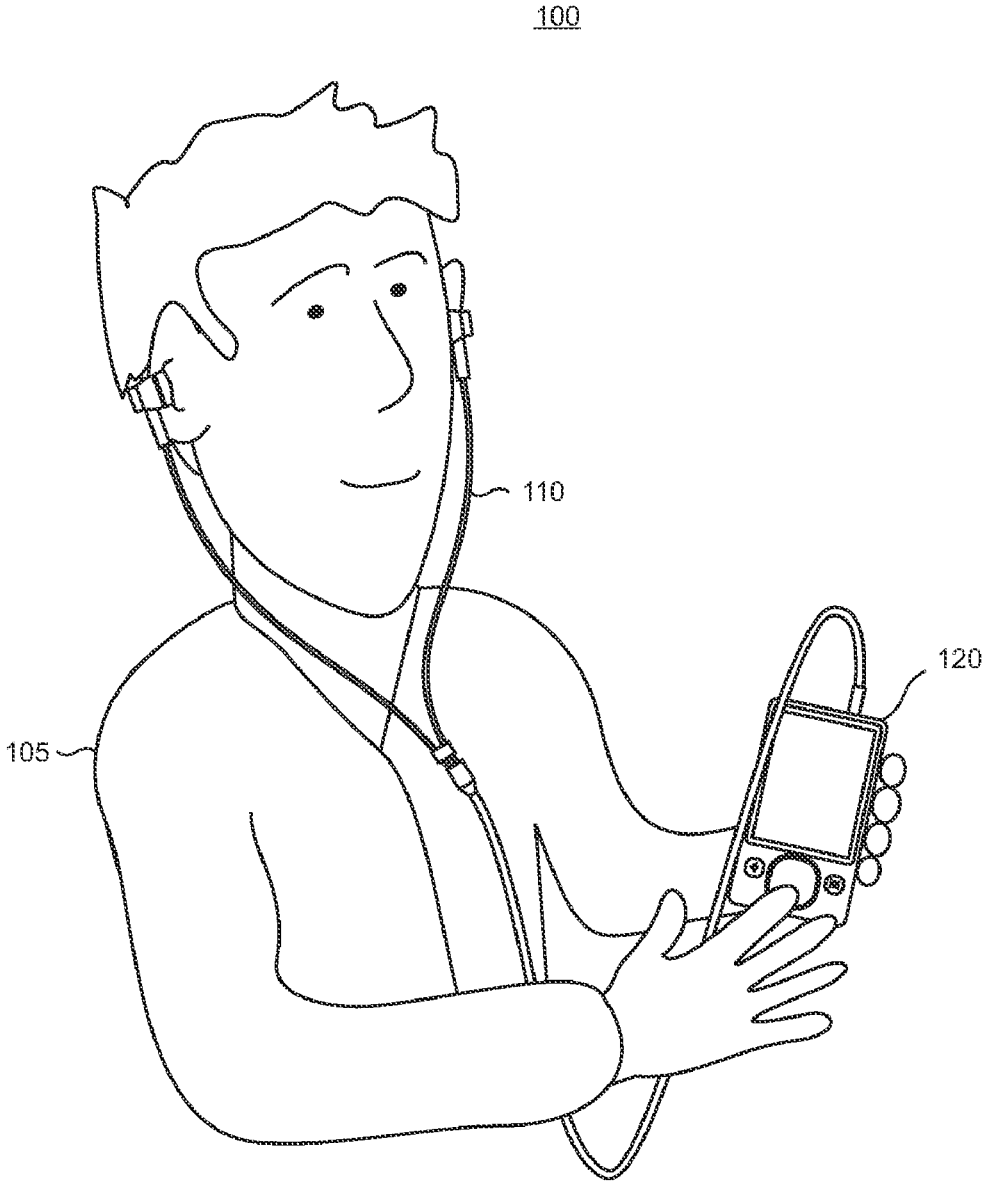
FIG. 1 shows an illustrative portable device usage environment where a user listens to audio content being rendered through earphones by a personal media player.

FIG. 1 shows an illustrative portable device usage environment 100 where a user 105 listens to audio content being rendered through a set of earphones 110 by a personal media player 120. In this example, the personal media player 120 is representative of the popular players available on the market that can play audio content such as MP3 files or from over-the-air radio stations, display video and photographs, and render other content.

However, the present arrangement for cable management may also be utilized with a wide variety of media rendering devices that use cabled accessories such as earphones. Such devices include laptop PCs, PDAs, handheld game devices, mobile phones, smart phones, and other similar devices. Such devices are typically portable and powered by batteries that are generally rechargeable when connected to an external power supply (termed an "AC power adapter" because it converts AC power from the main power lines used in homes and offices, etc. to the DC power that is typically used by the device).

Earphones 110 are representative of a class of devices used to render audio which may also be known as headphones, earbuds, headsets, and by other terms. Earphones 110 generally will be configured with a pair of audio speakers (one for each ear), or less commonly a single speaker, along with a means to place the speakers close to the user's ears. Some earphone designs place the speakers in pads that sit around or on the ear. Other designs place the speaker immediately adjacent to the outer portion of the user's ear canal. These designs are typically compact and lightweight and are often sold and used with personal media players. It is noted that to avoid ambiguity among commonly used terms, the term "earphones" is used here to refer to a complete earphone set which includes the audio speakers, cables, plug, and other related components. The term "earphone speakers" is used to refer to the components of the earphones that are positioned near the user's ear when the earphones are in use.

The user 105 typically uses earphones 110 to enable audio content such as music to be consumed privately (i.e., without the audio content being heard by others) and at volume levels that are satisfactory for the user while maintaining good battery life in the device. In some cases, the earphones 110 will also incorporate a microphone to enable the user's voice and other sounds to be picked up, for example, when the earphones/microphone combination is used in conjunction with a mobile phone.

Figure 2:
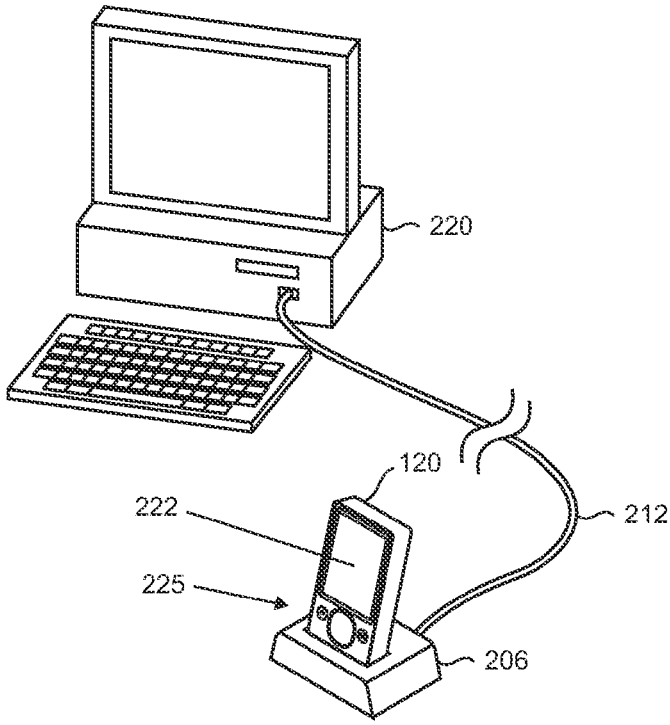
FIG. 2 shows an illustrative arrangement where a personal media player is inserted in a dock that is operatively coupled to a PC with a synchronization ("sync") cable.

The usage environment 100 for portable devices commonly extends to a home or office environment when a device is being synchronized with other devices or being charged. For example, FIG. 2 shows the personal media player 120 inserted in a dock 206 that is operatively coupled to a PC 220 with a sync (i.e., synchronization) cable 212. Docking the personal media player 120 to the PC 220 typically enables them to operatively communicate, for example, to synchronize data and share media content. A pair of mating connectors are utilized to implement the connection between the personal media player 120 and the dock 206, where one of the connectors in the pair is disposed in the player and the other is disposed in the recess of the dock 206 in which the player sits.

The dock 206 also typically provides a charging functionality to charge an onboard battery in the personal media player 120 when it is docked. It is noted that the sync cable 212 may also be directly coupled to the personal media player 120 (i.e., without the player being inserted into the dock 206). However, the dock 206 may generally be used to position the docked personal media player 120 so that the player's display 222 may be readily seen and the controls 225 conveniently accessed by the user 105.

Figure 3:
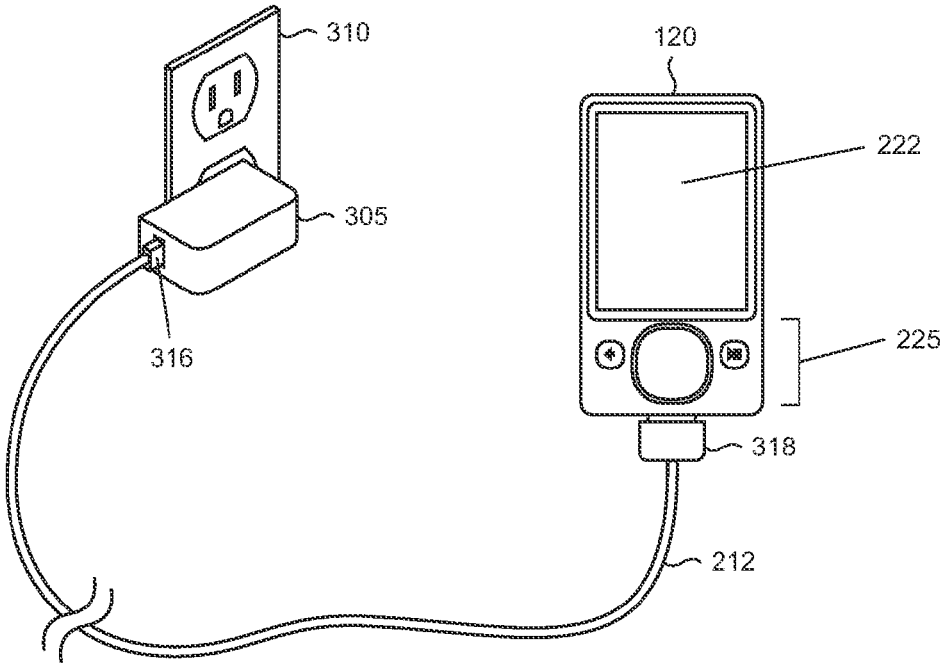
FIG. 3 shows an illustrative arrangement where a personal media player is being charged by a power adapter through the sync cable.

FIG. 3 shows the personal media player 120 being directly coupled to the sync cable 212. In this example, the sync cable 212 is coupled to an AC power adapter 305 that converts the AC power from a wall outlet 310 into DC power that is typically used to recharge the player's onboard rechargeable battery. Accordingly, in many implementations the sync cable 212 is designed to be removably couplable to the various devices in the environment 100 using connectors that are disposed at each of the sync cable. For example, the end of the sync cable 212 that connects to the AC power adapter 305 and PC 220 may use a standardized connector 316 such as one configured in accordance with USB (Universal Serial Bus) or IEEE-1394 (Institute of Electrical and Electronics Engineers). The other end of the sync cable 212 will typically use a device-specific connector 318 that mates with a corresponding connector that is disposed in the personal media player 120 and/or the dock 206.

Figure 4:
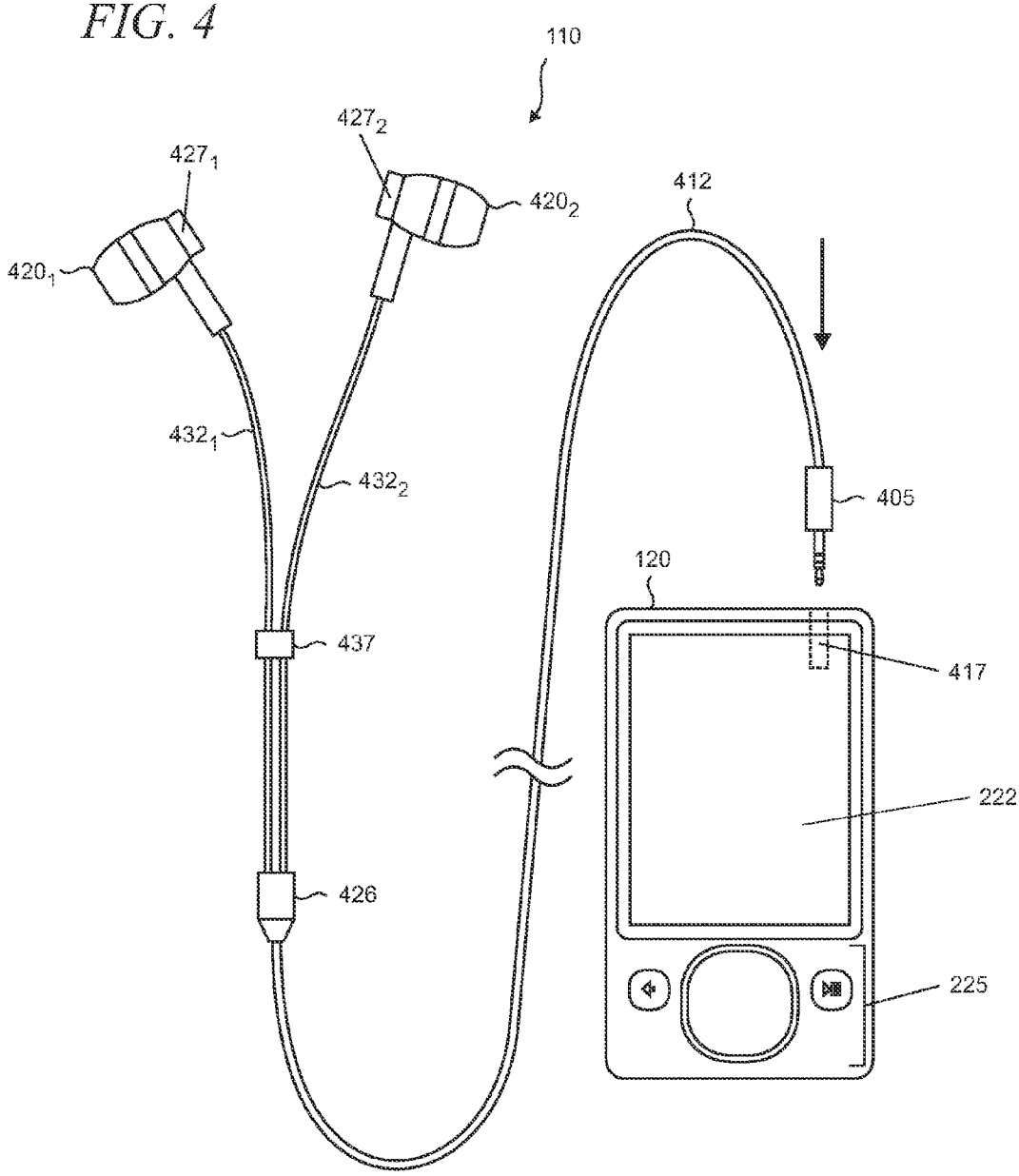
FIG. 4 shows details of components used in the earphones shown in FIG. 1.

FIG. 4 shows details of components used in the portable media player 120 and earphones 110. The earphones 110 are mechanically and operatively coupled to the media player 120 with a plug 405 that is located at the distal end of a single cable 412. Plug 405 interfaces with a mating jack 417 that is disposed on a top surface of the personal media player 120, in this example, so that an audio output signal generated by the player 120 may be rendered by the earphone speakers $\mathbf{420}_1$ and $\mathbf{420}_2$. Typically, the audio output signal is a stereophonic signal that, when rendered by the earphone speakers 420, produces a stereo effect for the user. Accordingly, the earphone speakers 420 are generally identified as being either intended for the right or left ear of the user.

The single cable 412 runs between the plug 405 and splitter 426. The splitter 426 is generally arranged from a resilient and durable material such as molded polymer which is intended to protect the junction point where the single cable 412 splits into individual cables $\mathbf{432}_1$ and $\mathbf{432}_2$ which respectively are coupled to earphone speakers $\mathbf{420}_1$ and $\mathbf{420}_2$. Accordingly, the single cable 412 which carries both left and right channels of the stereophonic signal will have twice the number of signal conductors as the individual cables 432 which carry either the left or right channel of the stereophonic signal in most implementations.

Figure 4A:
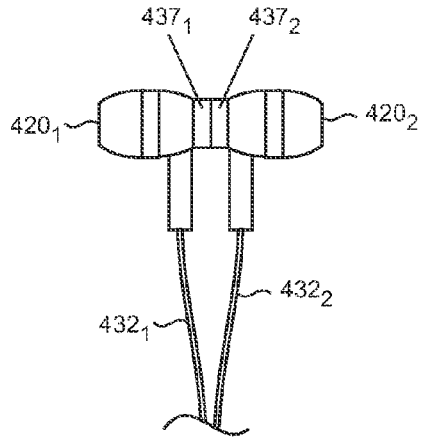
FIG. 4A shows a pair of earphone speakers that are magnetically coupled for storage.

In this example, the earphone speakers $\mathbf{420}_1$ and $\mathbf{420}_2$ are configured with respective magnetic elements $\mathbf{427}_1$ and $\mathbf{427}_2$ that are positioned at the end of the earphone speakers $\mathbf{420}_1$ and $420_2$ opposite the portion of the speaker that fits in the user's ear. The magnetic elements 427 have their poles aligned in such a way that the earphone speakers 420 become magnetically coupled when in contact, as shown in FIG. 4A. Such magnetic coupling may help to keep the earphones organized and tangle-free when stored.

Between the splitter 426 and the earphone speakers 420 is a slider 437 which is generally formed, for example, from a molded resilient polymer. Polymer materials are typically utilized for the splitter 426 and slider 437 because of the material's light weight, low cost, ease of manufacturability, appearance, and other factors. However, other materials may also be utilized as required to meet the needs of a particular implementation.

Figure 5:
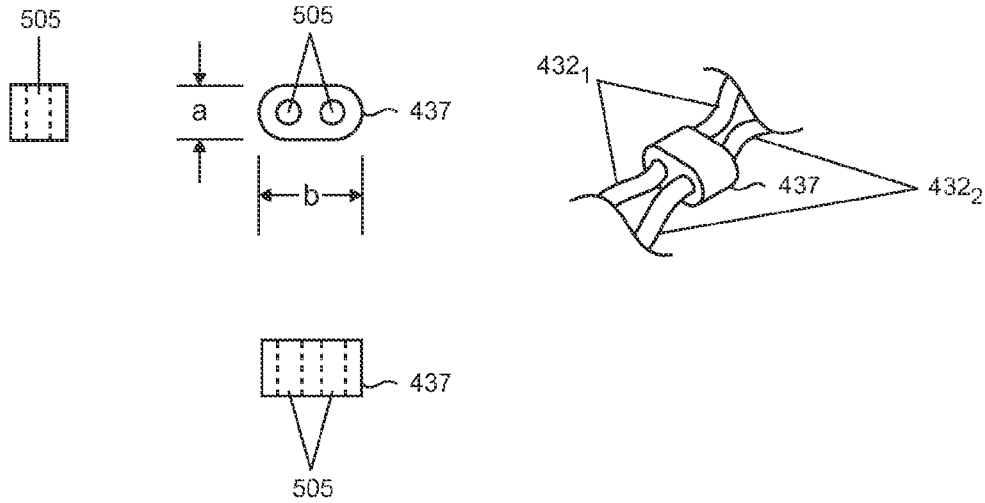
FIG. 5 shows enlarged and detailed top, front, side, and isometric views of an illustrative slider used to manage the pair of cables that are coupled to the individual left-ear and right-ear earphones.

As shown in FIG. 5, Slider 437 includes a pair of channels 505 (i.e., through-holes) through which the individual cables 432 slideably pass when the slider is assembled in a finished set of earphones 110. Slider 437 enables a user to adjust the point where the individual cables 432 may be separated which is helpful to manage the effective lengths of the individual cables, for example, when adjusting the earphones 110 to fit comfortably.

As shown in the top and isometric views of FIG. 5, the slider 437 has a sectional profile that comprises rectangular shape with semi-circular ends referred to here as a rounded rectangular shape. It is emphasized that this particular shape is illustrative and other shapes may also be utilized. The particular shape selected will typically be a matter of design choice that will consider factors such as aesthetic appearance, manufacturability, and cost.

In general, a variety of basic geometric shapes such as oval, polygonal, and circular shapes may be used as well as more complex or compound shapes that combine flat and curved surfaces. However, at least one rounded, tapered, or semi-tapered end for the slider 437 may often be particularly suitable in many implementations as it would allow an embodiment of the present cable management arrangement (i.e., the cable management clip) to be more easily installed in some cases. As shown in the top view of the slider 437, it has dimensions indicated by "a" and "b" for its respective short and long sides.

In accordance with the principles of the present cable management arrangement, it will generally be desired to select the particular shape and size to be commonly utilized for several components in the earphones 110. This commonly-used shape enables the same cable management clip (shown in FIGS. 9 and 9A and described in the accompanying text) to be removably clipped to various different components of the earphones 110.

Here, for example, the slider 437, splitter 426, plug 405, and the stem portions of the earphone speakers $420_1$ and $420_2$ commonly share the same rounded rectangular shape and size so that the same cable management clip can be removably attached (i.e., clipped) to each of them according to the preference of the user 105. The commonly-used rounded rectangular shape for these illustrative components is shown, respectively, in FIGS. 5-8. However, in alternative arrangements, it may be desirable to configure only some of the earphone components with a common shape, or arrange the cable management clip to be removably couplable to only one particular component.

Figure 6:
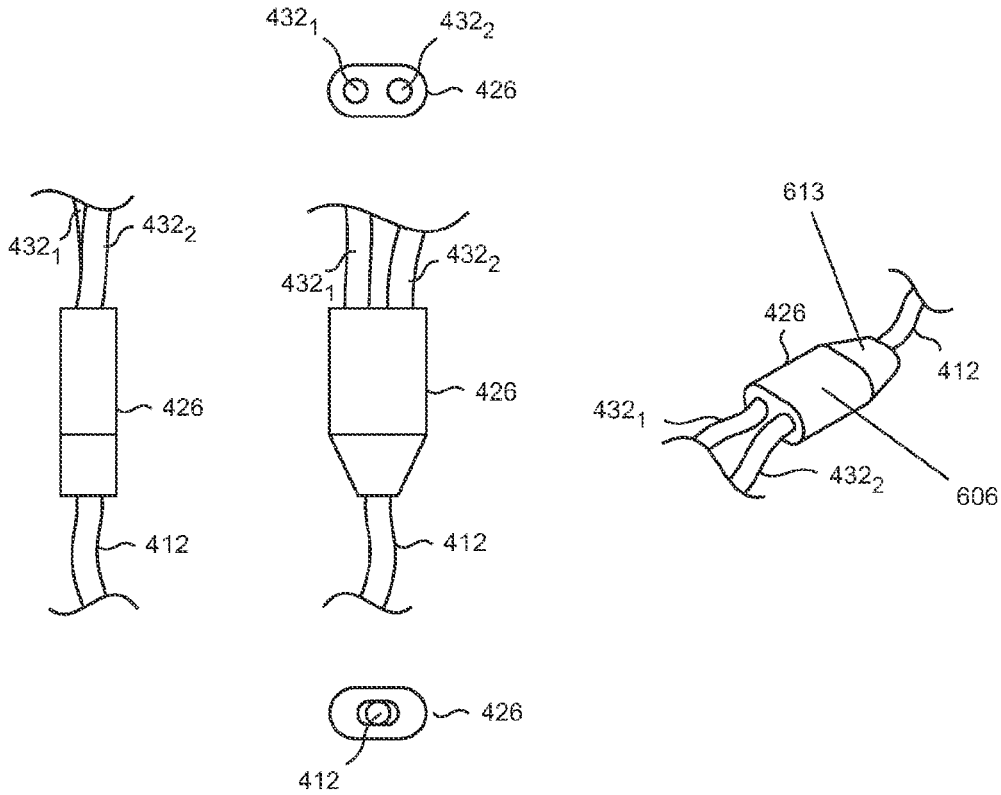
FIG. 6 shows enlarged and detailed top, front, bottom, side, and isometric views of an illustrative splitter used to provide a separation point from a single cable to the pair of cables that are coupled to the individual left-ear and right-ear earphones.

As shown in FIG. 6, the splitter 426 includes a main body 606 from which the two individual cables 432 extend, along with a tapered portion 613 from which the single cable 412 extends. The main body 606, as shown in the top and bottom views of the splitter 426, has the same rounded rectangular shape as the slider 437, and is similarly sized (i.e., shares the dimensions "a" and "b" shown in FIG. 5).

Figure 7:
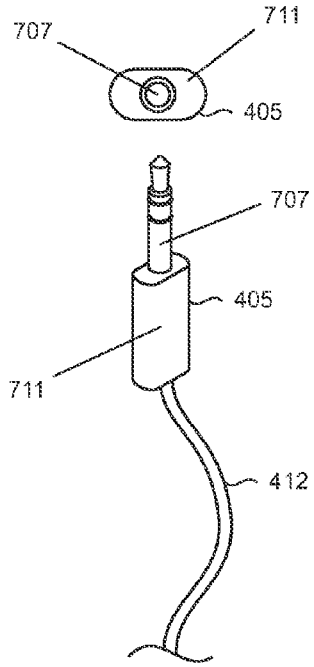
FIG. 7 shows enlarged and detailed isometric and top views of an illustrative earphone cable plug.

As shown in FIG. 7, the plug 405 includes a metal shaft 707 that provides the signal paths and which interfaces with the mating jack 417 (FIG. 4) in the personal media player 120. A body portion 711, which the user 105 typically grasps when inserting and removing the plug 405 from the jack 417, has the same rounded rectangular shape and is similarly sized as the slider 437 and splitter 426.

Figure 8:
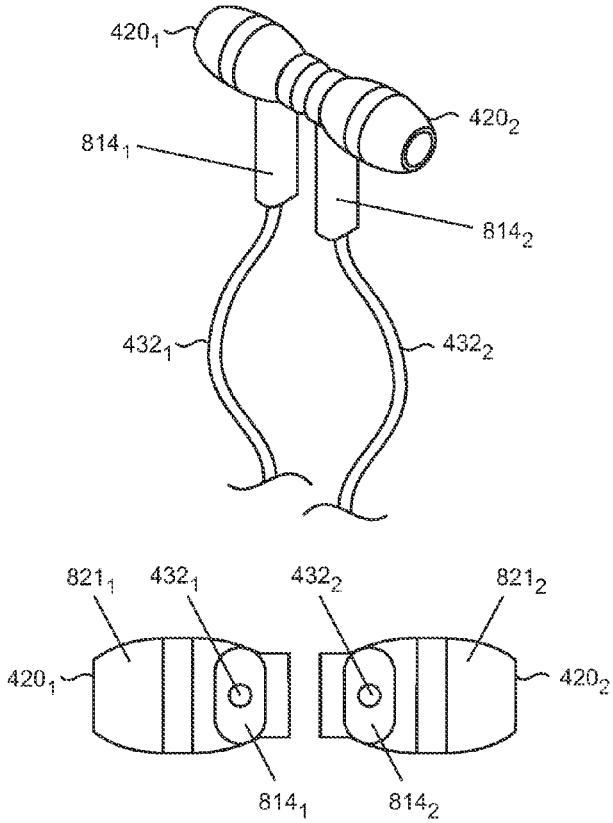
FIG. 8 shows enlarged and detailed isometric and bottom views of illustrative earphone speakers.

As shown in FIG. 8, each earphone speaker 420 includes a stem $814_1$ and $814_2$ that normally projects substantially downward from the respective bodies of the earphone speakers $420_1$ and $420_2$ when the earphones 112 are used. As shown in the bottom view in FIG. 8, the stems 814 have the same rounded rectangular shape and are similarly sized as the slider 437, splitter 426 and plug 405.

FIGS. 9-12 show various illustrative examples of the present cable management clip that may be used to manage the cables associated with accessories such as the earphones 110 and sync cable 212 (shown in FIGS. 1 and 2, respectively, and described in the accompanying text).

Figure 9:
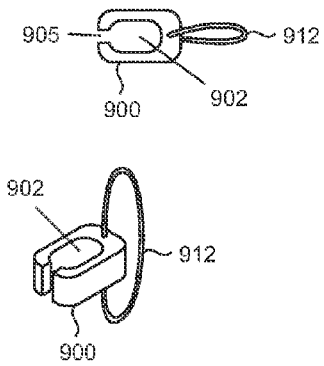
FIG. 9 shows top and isometric views of an illustrative cable management clip having an elastically deformable loop where the clip has a receiving area with a rounded rectangular shape.

As shown in FIG. 9, the cable management clip 900 is configured to include a receiving area 902 that has the same rounded rectangular shape and approximate size as used with components in the earphones 110 including the slider 437, splitter 426, plug 405, and earphone speaker stems 814 (FIGS. 4 and 8). A slot 905 is provided on a side of the clip 900 that provides access to the receiving area 902.

The cable management clip 900 will typically be configured using a semi-flexible material, such as a polymer, that enables the clip to be elastically deformed and removably coupled to the components using a snap fit when the user pushes the component through the slot 905 and into the receiving area 902. Typically, the slot and receiving area 902 are sized, and the stiffness of the material utilized for the clip is selected so that a circumferential clamping force is imparted from the receiving area of the cable management clip 900 to the earphone component so that the clip is held securely.

Figure 9A:
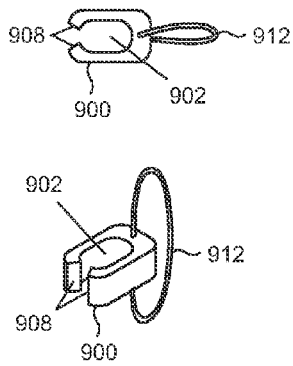
FIG. 9A shows top and isometric views of the illustrative cable management clip shown in FIG. 9 having optional chamfered leading edges.

The particular geometry and materials for the cable management clip 900 will generally be selected to balance and/or optimize how secure the clip is when snapped into place along with the ease in which the clip is installed and removed from the accessory component. Various geometric features, such as chamfered edges 908, as shown in FIG. 9A, may also be optionally utilized to reduce the insertion forces when clipping the cable management clip 900 onto the accessory component, or to provide visual guidance to the user 105 as to how the clip is intended to be interfaced with the component. The chamfered edges 908 engage with the rounded or tapered portion of the accessory component (as described above) to help direct a lateral spreading force to the clip 900 to enable it to pass around the component when being clipped into place by the user 105.

Locating features such as ribs, keyways, and stops (not shown) that are disposed on an interior surface of the clip 900 (i.e., in the receiving area 902) may also be utilized to provide a means to locate or register the clip in a desired axial location along the component of the accessory. Such features may interface with corresponding mating features in the component, for example.

The cable management clip 900 is further configured with a loop 912 made of elastically deformable material which extends from the top and bottom faces of the clip, as shown. The loop 912 is typically configured from an elastically deformable material in order to enable it to readily conform or adjust as needed to different usage settings. For example, the loop 912 can adjust to accommodate a range of button sizes when it is fastened to clothing. When used for accessory cable stowage, the loop 912 can conform to a range of different cable thicknesses and bundle sizes.

A suitable material for the loop 912 in some applications may often be a polymeric elastomer, or synthetic or natural rubber, for example, as such materials have characteristics such as flexibility and elasticity (i.e., reversible elongation) that is desirable in many scenarios to which the present cable management arrangement may be applied. In alternative arrangements the loop 912 may comprise a flexible material that has limited elastic characteristics, such as wire or non-elastic plastic.

The loop 912 may be fabricated from one or multiple strands of elastic material, and may further include a jacket or covering using fabric including threads such as nylon, multifilament polypropylene, polyester, or cotton fibers (or combinations thereof). This configuration may provide a measure of durability to the loop 912, or improve the feel of the loop when touched and add to a perception of quality.

The overall size (e.g., length and diameter) of the loop 912, and the degree of elasticity utilized will typically be selected to meet the requirements of a specific implementation. Generally, however, the loop 912 is sized to be just large enough to be conveniently wrapped around a coiled or bundled cable of an accessory (e.g., earphones 110 or sync cable 212) when the accessory is stored, while still being small enough to be securely fastened behind a button on the user's clothing without slipping off. Too long a loop 912 could lead to the loop itself getting caught or snagged by an object which defeats the purpose for which it is intended. In addition, an excessively long loop 912 could be cumbersome to use or be perceived as being untidy when clipped to an accessory but not used (i.e., not fastened to a button or used to stow a cable).

Figure 10:
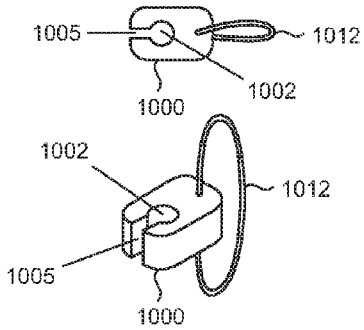
FIG. 10 shows top and isometric views of an illustrative cable management clip having an elastically deformable loop where the clip has a substantially circular accessory receiving area.

FIG. 10 shows an alternative illustrative configuration for a cable management clip 1000 in which the receiving area 1002 has a circular shape and is sized to be clipped to a cable such as the single cable 412 or individual cables 431 in the earphones 110 by passing the cable through the slot 1005. Clip 1000 uses an elastically deformable loop 1012 that is arranged in a similar manner as loop 912 shown in FIG. 9 and described in the accompanying text.

Figure 11:
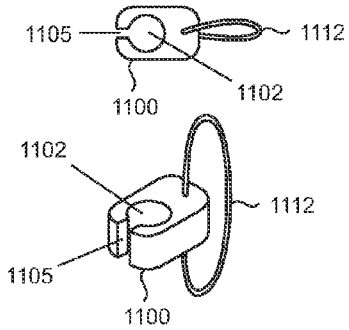
FIG. 11 shows top and isometric views of an illustrative cable management clip having an elastically deformable loop where the clip has a circular accessory receiving area that is relatively larger than that shown in FIG. 10.

FIG. 11 shows an alternative illustrative cable management clip 1100 in which the receiving area 1102 is larger than the receiving area 1002 so that the clip 1100 may be clipped to the sync cable 212 shown in FIGS. 2 and 3, where the sync cable 212 will typically have a larger diameter than the cables used in the earphones 110. The slot 1105 in the clip 1100 may also be sized to be larger than the slot 1005 in clip 1000. Clip 1100 also uses an elastically deformable loop 1112 that is arranged in a similar manner as loop 912 shown in FIG. 9 and described in the accompanying text.

Figure 12:
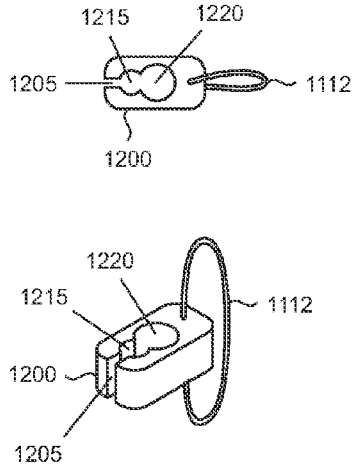
FIG. 12 shows top and isometric views of an illustrative cable management clip having an elastically deformable loop where the clip has a receiving area that is configured to receive cables of different diameters.

FIG. 12 shows an alternative illustrative cable management clip 1200 in which the receiving area is configured to receive cables of different diameters. For example, the first portion 1215 of the receiving area is sized to receive a cable used in the earphones (e.g., single cable 412 or one of the individual cables 432 shown in FIG. 4) which has a relatively small diameter. The second portion 1220 of the receiving area is sized to receive the sync cable 212 which has a relatively large diameter compared with the cables used in the earphones 110. Clip 1200 also includes a slot 1205 through which access to the receiving area is gained.

Figure 13:
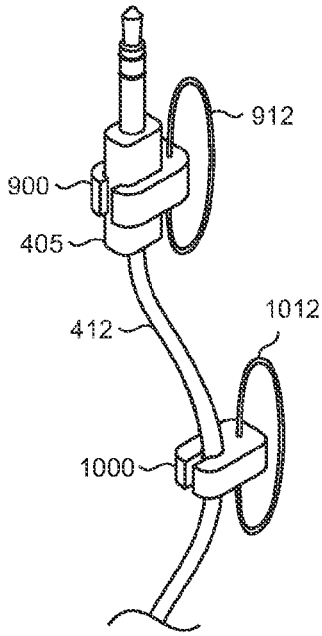
FIG. 13 shows a cable management clip as detachably coupled to an earphone cable plug.

FIG. 13 shows the cable management clip 900 as detachably clipped (i.e., coupled) to the plug 405. Cable management clip 1000 is shown as detachably clipped to the single cable 412.

Figure 14:
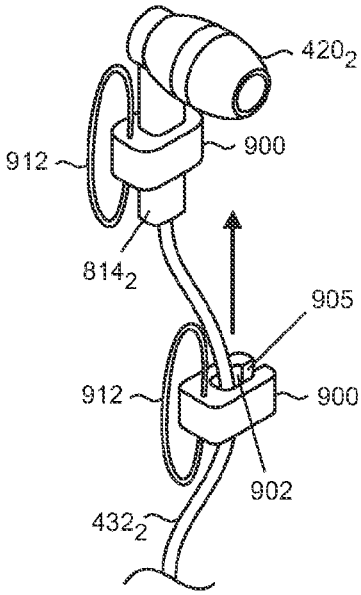
FIG. 14 shows a cable management clip as detachably coupled to an earphone speaker.

Similarly, FIG. 14 shows the cable management clip 900 as detachably clipped to the stem $\mathbf{814}_2$ of earphone speaker $\mathbf{420}_2$. FIG. 14 also shows an alternative method with which the user 105 might attach the cable management clip 900 to the earphone speaker $\mathbf{420}_2$, or other accessory component. In this alternative method, the user first passes the cable (in this case individual cable $\mathbf{432}_2$) through the slot 905 of the clip 900 and into the receiving area 902. Then, the cable management clip 900 is slid up the cable until it meets the accessory component. The clip 900 can then be slideably engaged with the component until it reaches a desired location.

Figure 15:
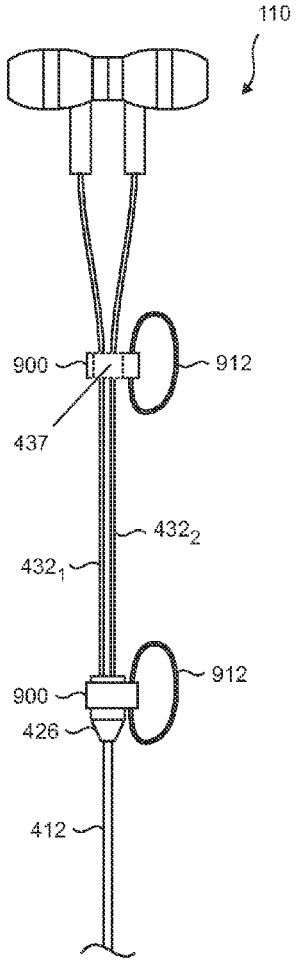
FIG. 15 shows cable management clips as detachably coupled to the earphone cable splitter and slider.

The cable management clip 900 may be clipped onto the splitter 426 and slider 437 in a similar manner as the earphone speakers 420 and plug 405, as shown in FIG. 15.

FIGS. 16-20 show respective views of various alternative illustrative examples of cable management clips that use different configurations of elastically deformable loops and optionally utilized hooks. The hooks provide one method by which the elastically deformable loop may be retained or fastened when it is wrapped around a bundled cable for storage. Some hook arrangements may also be used to temporarily fasten or clip a cable management clip to an article of clothing or other articles such as handbags, backpacks, and the like.

Figure 16:
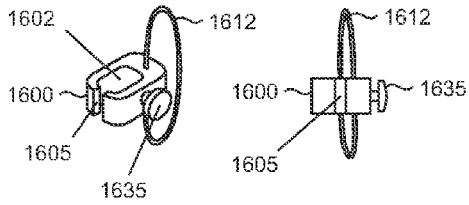
FIGS. 16-20 show respective views of various alternative illustrative examples of cable management clips that use different configurations of elastic loops and hooks.

FIG. 16 shows an illustrative cable management clip 1600 with receiving area 1602, slot 1605, and elastically deformable loop 1612 that is generally configured in a similar manner as clip 900 shown in FIGS. 9 and 9A and described in the accompanying text. However, in this example, the clip 1600 is further provided with a hook 1635 that extends from its front face. In this example, the hook 1635 is configured as a circular button that is positioned on the end of a short shaft. The center of the button is substantially aligned with the axis of the shaft to enable the hook 1635 to capture the elastically deformable loop 1612 from different directions which may be beneficial in some cases. It is emphasized that a variety of different hook types, configurations, geometries, shapes, and orientations may be used with the present cable management arrangement. The circular button hook 1635 is just one illustrative example.

In most applications of the present cable management arrangement, the hook will be integrally formed, for example using conventional plastic molding or fabrication techniques, with the clip 1600. In alternative arrangements, the hook will be a separate component that may be, for example, user installable and removable.

Figure 17:
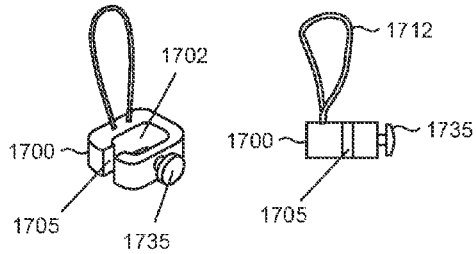

The elastically deformable loop may be configured to extend from different portions of the cable management clip. For example, as shown in FIG. 17, the elastically deformable loop 1712 extends from the top face of the clip 1700 behind the receiving area 1702. In this example, the cable management clip 1700 also includes a hook 1735, but the alternative loop configuration can also be utilized for clips that do not utilize a hook. The elastically deformable loop may also extend from other portions, for example, adjacent to the slot 1705.

Figure 18:
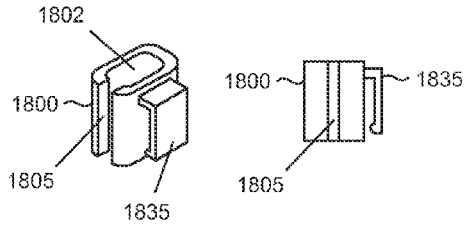

FIG. 18 shows an alternative illustrative cable management clip 1800 that uses a downward extending hook 1835 that is configured for being temporarily and removably clipped to clothing, for example a shirt pocket, or other article. The hook 1835 is normally configured with some flexibility and spring-type bias so that when displaced by being clipped to the clothing or article, it will tend to grip with an inwardly directed force (i.e., in the direction of the receiving area 1802) so that the cable management clip 1800 stays in place in a secure manner. While the hook 1835 is shown extending downwards in FIG. 18, other orientations may also be utilized to meet the requirements of a particular application. For example, the hook may be pointed in the direction of the slot 1805, or away from it in a sideways orientation.

In this example, the cable management clip is not configured with a loop. Such a configuration still enables effective cable management when the accessory is in use, although the elimination of the loop means the clip does not have a role in managing cables when stored. However, for cost reasons and to address varying personal preferences, cable management arrangements that use only a hook (but have no loop) can still be desirable for some applications.

Figure 19:
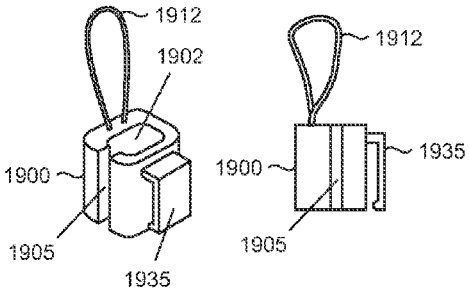
Figure 20:
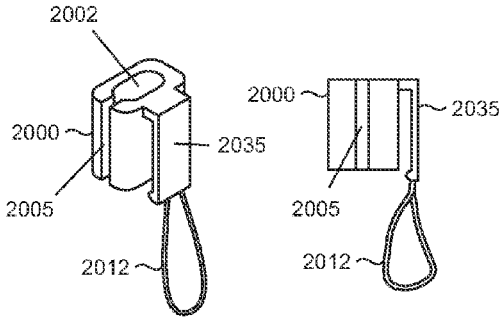

By comparison to the cable management clip shown in FIG. 18, the clips 1900 and 2000 shown respectively in FIGS. 19 and 20 utilize an elastically deformable loop in combination with a hook. The hooks 1935 and 2035 can be used to temporarily fasten the cable management clips to clothing or other articles, in a similar manner as described above, as well as for being usable to retain the elastically deformable loops 1912 and 2012, respectively, when an accessory such as the earphones 110 and sync cable 212 are bundled for storage.

In a similar configuration to that shown in FIG. 17, the elastically deformable loop 1912 extends from the top face of the cable management clip 1900 behind the receiving area 1902, as shown in FIG. 19. With clip 2000, the elastically deformable loop 2012 extends from the leading edge of the hook 2035 as shown in FIG. 20.

The removably attachable cable management clip as shown in FIGS. 9-20 and described in the accompanying text can be expected to meet the requirements of many applications where flexible and effective cable management solutions are needed. However, many of the benefits of the present arrangement can be realized using elastically deformable loops and/or hooks that are integrated into one or more of the components used in an accessory.

Figure 21:
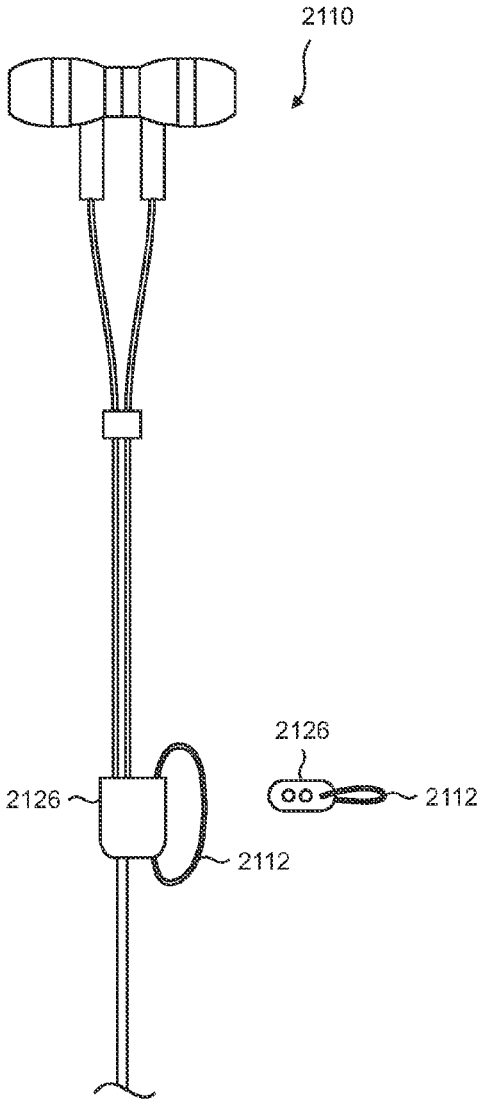
FIG. 21 shows enlarged and detailed isometric and bottom views of illustrative left-ear and right-ear earphones.

For example, as shown in FIG. 21, an elastically deformable loop 2112 extends from the side of a splitter 2126 used with earphones 2110. Splitter 2126 also incorporates an integrally formed hook in a button configuration that is similar to the arrangements shown in FIGS. 16 and 17 and described in the accompanying text.

Figure 22:
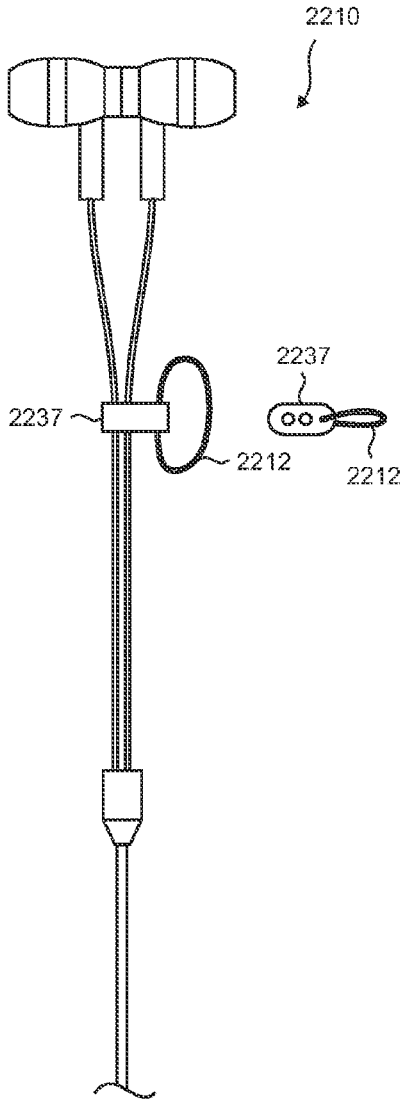
FIG. 22 shows an illustrative example of a cable management device having an elastically deformable loop where the device is integrated with the earphone cable splitter.

As shown in FIG. 22, an elastically deformable loop 2212 extends from the side of slider 2237 used with earphones 2210. In alternative arrangements, an elastically deformable loop and/or hook can be included with both the splitter and slider, or may be incorporated into the plug or earphone speakers.

Figure 23:
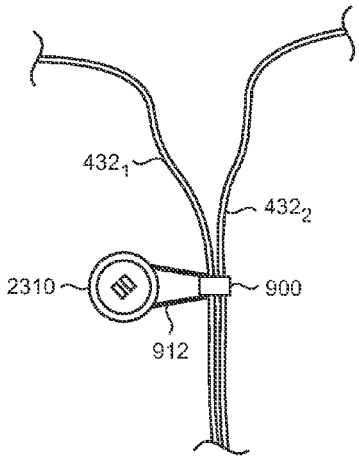
FIG. 23 shows an illustrative example of a cable management clip in use, where the elastically deformable loop is positioned behind a button on clothing.

FIG. 23 shows an example of a first illustrative use of the elastically deformable loop described above. As shown, a loop 912 extending from the cable management clip 900 when coupled to a slider is shown looped around a fastener such as a button 2310 attached to a user's clothing. The integrated loop style shown in FIG. 22 would function and appear similarly.

This use of the elastically deformable loop in this manner can help the user manage the cables in the earphones, for example, by holding the slack in the cable close to the user's body to keep it out of the way and prevent it from getting caught or snagged. As users frequently listen to audio content while engaged in a variety of activities, including those involving a lot of motion such as walking and jogging, for example, such cable management can significantly increase the quality of the experience and overall satisfaction with the earphones.

Figure 24:
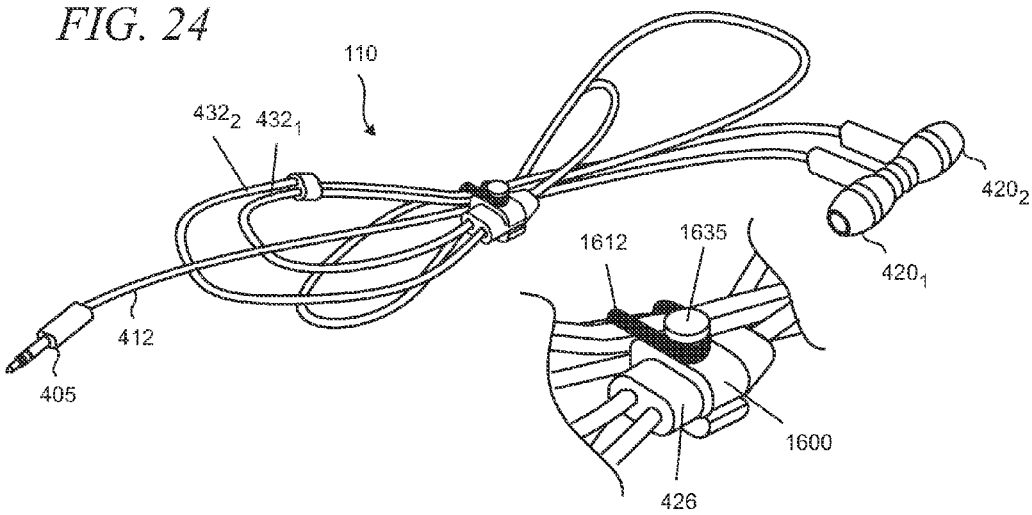
FIG. 24 shows an overall view and an enlarged detail view of an illustrative example of a cable management clip in use where a set of earphones is bundled for storage using the elastically deformable loop.
Figure 25:
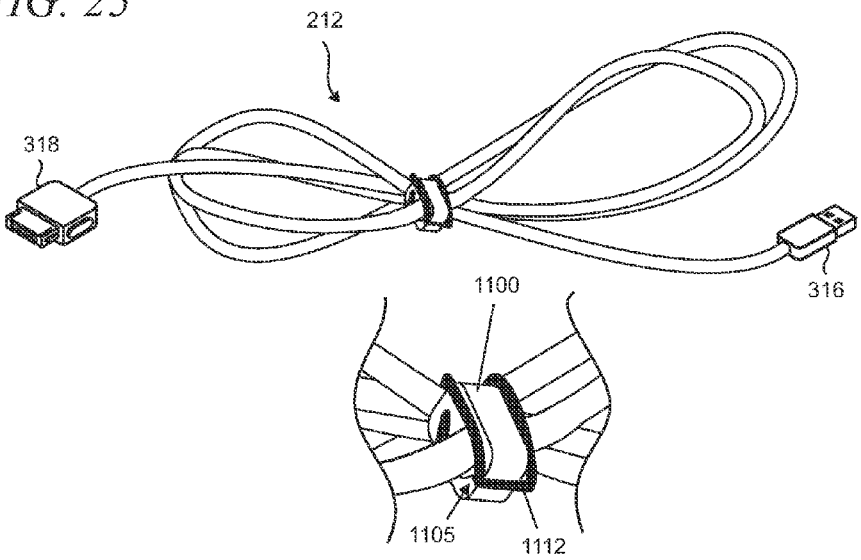
FIG. 25 shows an overall view and an enlarged detail view of an illustrative example of a cable management clip in use, where a sync or charger cable is bundled for storage using the elastically deformable loop.

FIGS. 24 and 25 show examples of a second illustrative use of the elastically deformable loop to wrap around a bundled cable of an accessory to hold it together for storage. In FIG. 24, the cable management clip 1600 shown in FIG. 16 is clipped onto the splitter 426 of the earphones 110. The elastically deformable loop 1612 (highlighted in black for clarity) is wrapped around the cables (i.e., single cable 412 and individual cables 432 and then looped over the hook 1635 to engage and retain it. As the loop 1612 is stretched (i.e., elastically elongated) as it wraps around the cables, it imparts a proportional compressive force to keep the cables securely bundled.

FIG. 25 shows the cable management clip 1100 shown in FIG. 11 as clipped to the sync cable 212. The elastically deformable loop 1112 is wrapped around the bundled cable 212 and then engaged in the slot 1105 that forms the access point to the receiving area in the clip 1100.

When used to neatly secure a cable of an accessory for storage, the elastically deformable loop provides a significant cable management feature that complements its utility in managing cable slack when the accessory is being used. The elastically deformable loop thus serves a dual role which enhances its functionality while increasing its perceived value to users.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A cable management clip that is removably attachable to a component of an accessory used with an electronic device, comprising:

a body having a component receiving area that is configured to be substantially close fitting to the component, the body providing a means for removable attachment of the clip to the component with a snap fit;

a flexible, elastically deformable loop extending from a face of the body, the loop being configured to be removably attachable to an object for securing the cable management clip to the object; and a loop retainer being integrated with the body and configured for mateable engagement with the loop when the loop is elastically elongated.

2. The cable management clip of claim 1 in which the component is a cable of an earphone set and the receiving area is shaped to receive the cable.

3. The cable management clip of claim 1 in which the component is a stem of an earphone speaker in a set of earphones and the receiving area is shaped to receive the stem.

4. The cable management clip of claim 1 in which the component is a jack in a set of earphones and the receiving area is shaped to receive the jack.

5. The cable management clip of claim 1 in which the component is a cable used to synchronize or charge the electronic device and the receiving area is shaped to receive the cable.

6. The cable management clip of claim 1 in which the loop retainer comprises a hook that is configured for removable attachment to the object.

7. The cable management clip of claim 1 in which the object comprises a fastener or button on an article of clothing.

8. The cable management clip of claim 1 in which the loop retainer comprises a slot in the body.

9. A set of earphones arranged for use with an electronic device that is capable of playing audio, comprising:

a pair of stereophonic speakers that are configured for placement near a user's ear and further arranged for producing sound in response to electrical signals generated by the electronic device;

a pair of cables, each cable being coupled to respective speakers at a proximal end and having conductors for carrying an electrical signal generated by the electronic device;

a cable splitter disposed at respective distal ends of the pair of cables, the cable splitter being arranged to combine the conductors in the pair of cables into a single cable that is coupled at a proximal end of the single cable to the splitter;

a jack disposed at a distal end of the single cable, the jack being configured for electrically and mechanically interfacing with a mating plug disposed in the electronic device; and a cable management device comprising a loop of a flexible and elastically deformable material and a loop retainer, the loop being extendable from one of the speakers, or from the cable splitter, or from the jack, the loop being configured to be removably attachable to an object for securing the cable management device to the object, and the loop retainer being configured for mateable engagement with the loop when the loop is elastically elongated.

10. The set of earphones of claim 9 in which loop and loop retainer are disposed in a discretely-embodied clip that is arranged to be removably clipped to a component of the set of earphones, the component comprising at least one of the speakers, or the cable splitter, or the jack with a snap fit, the clip including a receiving area that is shaped to interface with the component.

11. The set of earphones of claim 10 in which the cable splitter, jack, and speakers each include a portion that shares a commonly-utilized and sized sectional profile that is arranged to interface with the receiving area of the clip in a substantially close fitting manner.

12. The set of earphones of claim 11 further including a slider that includes through-holes through which the pair of cables pass, the slider being configured to share the commonly-utilized and sized sectional profile for interfacing with the receiving area of the clip in a substantially close fitting manner.

13. The set of earphones of claim 12 in which the speakers are each arranged with a stem to which a cable in the pair of cables is coupled, the stem sharing the commonly-used and sized sectional profile.

14. The set of earphones of claim 13 in which the loop is formed from a material selected from one of elastomeric polymer, synthetic rubber, natural rubber, or wire.

15. The set of earphones of claim 14 further including a fabric jacket that is provided as a covering for the loop.

16. A method for providing cable management for accessories used with an electronic device, the method comprising the steps of:

providing a cable management clip including (a) a body having a receiving area that is configured to be substantially close fitting to a component of an accessory device, the body being configured for removable attachment of the clip to the component using a snap fit, (b) a flexible loop extending from a face of the body, the loop being configured to be removably attachable to an object for securing the cable management clip to the object, and (c) a loop retainer being integrated with the body and configured for mateable engagement with the loop; and configuring a plurality of components of one or more accessory devices to have a portion that includes a commonly-utilized and sized sectional profile that is adapted to interface with a receiving area in the body of the cable management clip.

17. The method of claim 16 in which the one or more accessory devices are selected from one of earphones, charger cables, or sync cables.

18. The method of claim 16 including a further step of packaging the cable management clip with the one or more accessory devices.

19. The method of claim 16 in which the component includes one of cable, cable connector, earphone cable splitter, earphone cable slider, earphone jack, or earphone speaker.

20. The method of claim 16 in which the loop is further arranged to be elastically extendable, and the loop retainer is adapted to secure the loop when the loop is elastically extended.

* * * * *

UNITED STATES PATENT AND TRADEMARK OFFICE

CERTIFICATE OF CORRECTION

PATENT NO. : 8,139,809 B2
APPLICATION NO. : 12/050943
DATED : March 20, 2012
INVENTOR(S) : Jubelirer et al.

It is certified that error appears in the above-identified patent and that said Letters Patent is hereby corrected as shown below:

Claim 4, Col. 10, line 51, after “component is a”, change “jack” to --plug--.
Claim 4, Col. 10, line 52, after “to receive the”, change “jack” to --plug--.
Claim 9, Col. 11, line 12, after “a”, change “jack” to --plug--.
Claim 9, Col. 11, line 12, after “cable, the”, change “jack” to --plug--.
Claim 9, Col. 11, line 14, after “mating”, change “plug” to --jack--.
Claim 9, Col. 11, line 19, after “or from the”, change “jack” to --plug--.
Claim 10, Col. 11, line 29, after “splitter, or the”, change “jack” to --plug--.
Claim 11, Col. 11, line 33, after “splitter,”, change “jack” to --plug--.
Claim 19, Col. 12, line 36, after “earphone”, change “jack” to --plug--.

Signed and Sealed this
Twenty-second Day of May, 2012

David J. Kappos

David J. Kappos
*Director of the United States Patent and Trademark Office*